US005873809A

United States Patent [19]

Kempster et al.

[11] Patent Number: 5,873,809

[45] Date of Patent: Feb. 23, 1999

[54] PACKAGING MATERIAL MAKING MACHINE

[75] Inventors: Mark Alan Kempster; Timothy Edward Lawrence Panther, both of Wellwyn Garden City, United Kingdom

[73] Assignee: Easypack Limited, Hertfordshire, United Kingdom

[21] Appl. No.: 737,230

[22] PCT Filed: May 15, 1995

[86] PCT No.: PCT/GB95/01094

§ 371 Date: Mar. 7, 1997

§ 102(e) Date: Mar. 7, 1997

[87] PCT Pub. No.: WO95/31296

PCT Pub. Date: Nov. 23, 1995

[30] Foreign Application Priority Data

May 18, 1994 [GB] United Kingdom ..... 94 09973

[51] Int. Cl.[6] ..... B31D 5/00

[52] U.S. Cl. ..... 493/464; 493/407; 493/416; 493/967

[58] Field of Search ..... 493/464, 967, 493/154, 407, 415, 416, 455, 459, 456, 461, 462, 463, 467, 458

[56] References Cited

U.S. PATENT DOCUMENTS

| | | | |
|---|---|---|---|
| 2,786,399 | 3/1957 | Mason | 493/464 |
| 2,924,154 | 2/1960 | Russell | 493/464 |
| 3,164,069 | 1/1965 | Wilkie | 493/464 |
| 3,347,136 | 10/1967 | Kure | 493/967 |
| 3,425,107 | 2/1969 | Matsui | 493/464 |
| 3,509,797 | 5/1970 | Johnson | 93/1 |
| 3,509,798 | 5/1970 | Johnson | 93/1 |
| 3,603,216 | 9/1971 | Johnson | 93/1 |
| 3,613,522 | 10/1971 | Johnson | 93/1 |
| 3,655,500 | 4/1972 | Johnson | 161/104 |
| 3,717,074 | 2/1973 | Rasmussen | 493/464 |
| 3,799,039 | 3/1974 | Johnson | 93/1 |
| 4,026,198 | 5/1977 | Ottaviano | 93/1 |
| 4,085,662 | 4/1978 | Ottaviano | 93/1 |
| 4,109,040 | 8/1978 | Ottaviano | 493/967 |
| 4,237,776 | 12/1980 | Ottaviano | 493/967 |
| 4,410,315 | 10/1983 | Frye | 493/464 |
| 4,421,501 | 12/1983 | Scheffer | 493/456 |
| 4,699,609 | 10/1987 | Komaransky et al. | 493/357 |
| 4,717,613 | 1/1988 | Ottaviano | 428/129 |
| 4,750,896 | 6/1988 | Komaransky et al. | 493/357 |
| 5,173,352 | 12/1992 | Parker | 428/174 |
| 5,188,581 | 2/1993 | Baldacci | 493/381 |
| 5,203,761 | 4/1993 | Reichental | 493/967 |

FOREIGN PATENT DOCUMENTS

| | | | |
|---|---|---|---|
| 92110127 | 1/1993 | European Pat. Off. | B31F 1/07 |
| 90907731 | 9/1993 | European Pat. Off. | B31F 5/02 |
| WO 92/05948 | 4/1992 | WIPO . | |
| WO 93/08980 | 5/1993 | WIPO . | |
| WO 93/19931 | 10/1993 | WIPO . | |

*Primary Examiner*—John Sipos
*Assistant Examiner*—Christopher W. Day
*Attorney, Agent, or Firm*—Jenkins & Wilson, P.A.

[57] ABSTRACT

In a machine for making packaging material, paper is pulled off a roll by two pairs of spaced rubber nip rollers, the lower ones of which rollers are driven. The edges of the paper roll over as the paper passes through the former and the rolled paper is pushed into a pair of meshing gear wheels in order to hold the rolled dunnage together loosely. A pair of blades cut the dunnage to the required length after it has passed through the gear wheels.

13 Claims, 5 Drawing Sheets

PACKAGING MATERIAL MAKING MACHINE

The present invention relates to a packaging material making machine and to a method of making packaging material.

In a known method of making paper dunnage a roll of paper is provided which is pulled over a conical former by driven, meshing gears. As the gears pull the paper from the supply roll the paper is rolled over and around the conical former and connected together at the region where the gears mesh. As the former is conical in shape it is difficult to ensure that the paper is controlled sufficiently to have the required shape when it arrives at the meshing gears. This is thought to be because the shape of the complete width of the paper is caused to be changed by the former over the complete extent of the travel of the paper over the former. Furthermore, as the object is to try and bulk up the paper to form the dunnage for packaging purposes, because the cogs that are connecting the overlap layers actually pull the paper off the supply, the paper is under tension in the direction of travel when it arrives at the gears and thereby, although the paper may be bunched up in a direction transverse to the extent of travel of the paper, the paper is taut in the direction of travel thereby forbidding any bunching up of the paper in the direction of travel.

EP 523 382 (Sealed Air Corporation) describes a machine that has feed rolls 20 that direct material towards driven texturing rolls 22. The plies P are then separated and maintained in tension between the texturing rolls 22 and the driven combining rolls 26.

According to one aspect of the present invention a packaging material making machine comprising a sheet material supply region arranged to supply sheet material to a former, pulling means arranged to pull sheet material from the supply region to the former and connecting means located downstream of the pulling means arranged to assist in maintaining the overlapping layers together is characterised in that the pulling means is arranged to push the sheet material to the connecting means. The connecting means may comprise crimping means.

By providing a separate pulling means to the connecting means more control is able to be placed over the supply of the paper to the connecting means.

The pulling means and the connecting means may each include at least one driven rotatable member and at least one of the rotatable members of the pulling means may include a resilient surface. Either of the driven rotatable members of the pulling means or the connecting means may be movable relative to another member or those means. The machine may include a common drive for both the pulling means and the connecting means. The diameter of the driven rotatable member of the pulling means may be greater than the diameter of the driven rotatable member of the connecting means.

The pulling means may be arranged to act along the extent of the former and may act through an opening in the former.

The connecting means may comprise a pair of gears arranged to mesh with the sheet material passing between the gears.

According to another aspect of the present invention a method of making packaging material comprising pulling sheet material from a supply region and causing the shape of the sheet material to change by using a former with the pulling means supplying sheet material from the supply region to a part that at least partially connects overlapping portions of the sheet material is characterised in that the pulling means pushes the sheet material to the part that at least partially connects the overlapping portions.

The present invention includes a method of making packaging material when using a packaging material making machine as herein referred to.

The former may include a generally flat surface against which sheet material is arranged to travel.

Such a machine may provide more control over the forming of the sheet material.

The former may include a flat surface having a lesser extent at a downstream location than it does at an upstream location in a direction transverse to the intended direction of travel of the sheet material.

The former may include an upper and a lower surface between which the paper is arranged to pass and the upper and lower surfaces may be spaced further from each other at a downstream location than at an upstream location.

The flat region may taper inwardly with respect to the intended direction of travel of the sheet material.

The machine may include pulling means arranged to act on the sheet material in the region of the former and the pulling means may be arranged to act on the sheet material through an opening in the flat surface of the former.

The former may include side portions extending transversely to the extent of the generally flat surface. The side portions may comprise curved portions and the curved portions may comprise arcuate portions.

According to a further aspect of the present invention a method of making packaging material comprises causing sheet material from a supply region to pass over a former having a generally flat surface to connecting means that at least partially connect portions of sheet material that have been caused to overlap by the former.

According to another aspect of the present invention the cutting apparatus comprises an anvil and at least two movable cutting members, each cutting member being arranged, in use, to move against a different part of the anvil to cut a different portion of material against the anvil.

Each cutting member may be arranged to move against the anvil at a different time to the other cutting member or, alternatively at substantially the same time.

Each cutting member may be pivotable.

Each cutting member may be mounted at a different side of the anvil.

Each cutting member may be arranged also to move against a common part of the anvil with the other cutting member.

The cutting members may be driven and may be connected by a driven member.

Two pairs of cutting members may be provided with two of each pair being arranged to move against the same part of the anvil at different times.

According to a further aspect of the present invention a method of cutting material against an anvil comprises moving at least two cutting members against a different part of the anvil to cut different portions of material against the anvil.

The present invention includes any combination of the features and limitations herein referred to.

The present invention may be carried into practice in various ways but two embodiments will now be described, by way of example and with reference to the accompanying drawings, in which.

Figure 1:
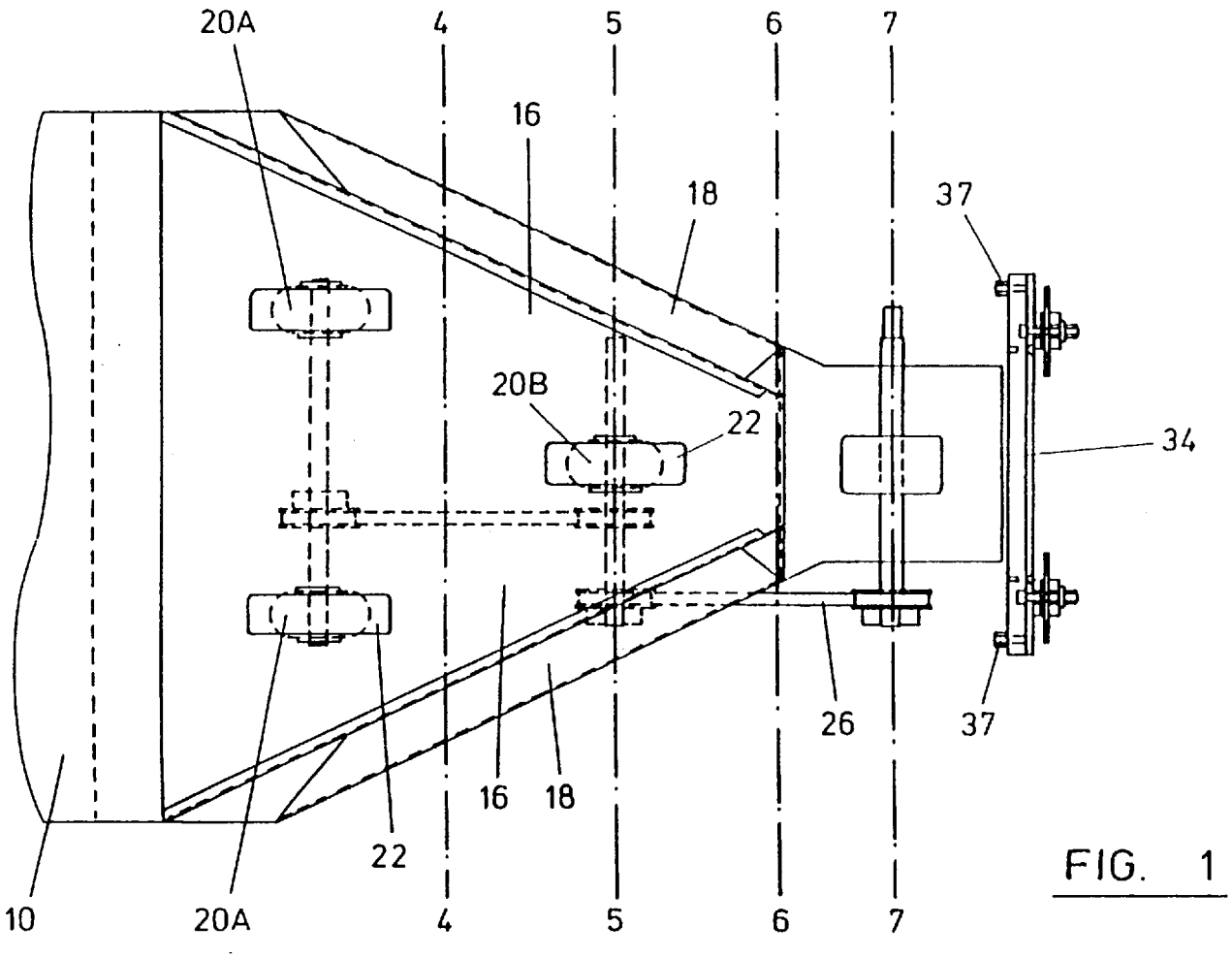
FIG. 1 is a plan view of the dunnage forming machine.
Figure 2:
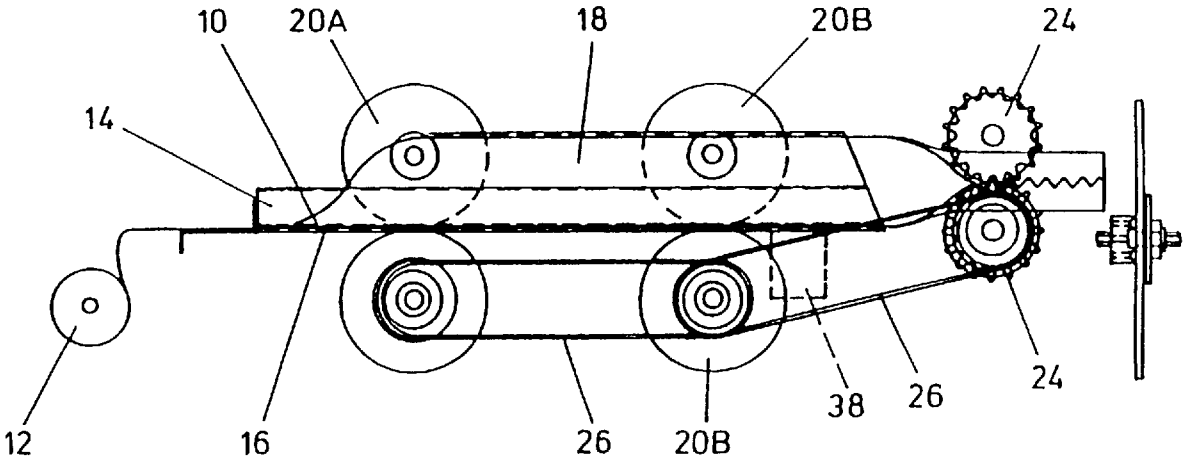
FIG. 2 is a side view of FIG. 1.
Figure 3:
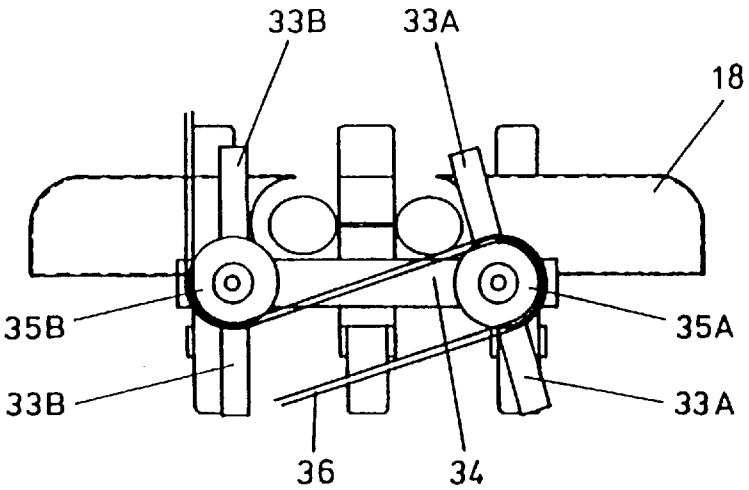
FIG. 3 is an end view of FIG. 1.

As shown in FIGS. 1 and 2, paper 10 is fed from a single multiply roll 12 of paper or, alternatively and not shown, from three separate paper rolls. The paper 10 passes between an upper flat tapering wall 14 and a lower flat inwardly tapering former 16. The sides of the former 16 are each defined by an arcuate wall 18 that extends through approximately 180°.

The paper is pulled off the roll 12 by two pairs of spaced rear rubber nip rollers 20A and a forward pair of rubber nip rollers 20B. The lower nip rollers are driven and the upper idler nip rollers are urged, by the weight of the wall 14 or by springs (not shown) towards the lower rollers to trap the paper 10 between the pairs of rollers.

The wall 14 and the former 16 have openings 22 to allow the upper nip rollers to contact the paper. The wall 14 starts near the rollers 20A to allow the free end of paper, on start up, to be fed directly into the rollers 20A. If desired, the rollers 20B can be omitted.

Figure 7:
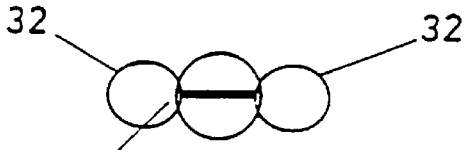
FIG. 7 is a cross-section through the line 7—7 of FIG. 1 showing the form that the paper takes up at that stage.
Figure 8:
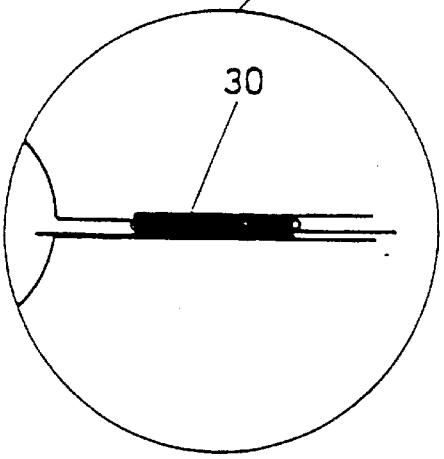
FIG. 8 is a close up view of the central part of the paper in FIG. 7.

At the ends of the former 16 the paper passes through a pair of meshing gear wheels 24. The gears are spring biased towards each other. The lower wheel is driven. The action of the gear wheels 24 deforms the surfaces of the paper that pass between them to hold the dunnage together loosely. The paper may be held in the position shown in FIGS. 7 and 8 as the gear wheels displace the cellulose fibres in adjacent layers to cause the fibres to interact. Alternatively or additionally the folds made in the paper by the gear wheels may be sufficient to connect the layers together.

The driven rollers and the driven gear wheel are drivably connected by a belt or chain 26. As the diameter of the driven roller is greater than the diameter of the gear wheel the surface of the roller travels at a greater speed than the gear wheel thereby causing the paper to be pushed into the gear wheels rather than the gear wheels pulling the paper through. The ratio between the driven roller and gear wheel is determined to feed paper at a slightly greater rate than the gear wheel could on its own. That ratio may be 1.07:1.0. This assists in the bunching up of the paper and therefore in increasing the bulk of the dunnage. As the gear wheels are spring loaded towards each other they can move apart occasionally, if required, to allow the paper to be pushed through. A motor 38, shown schematically, drives the gear 24 and then the lower roller 20B by the belt 26.

Immediately after the gear wheels a pair of blades 33A and 33B are provided to cut the dunnage at the required length. The operation of these knives can be manual or automatic and is described later.

Figure 4:
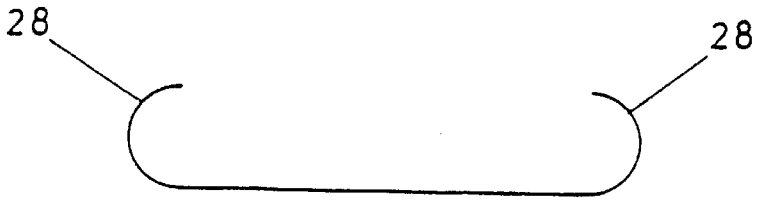
FIG. 4 is a cross-section through the line 4—4 of FIG. 1 showing the form that the paper takes up at that stage.
Figure 5:
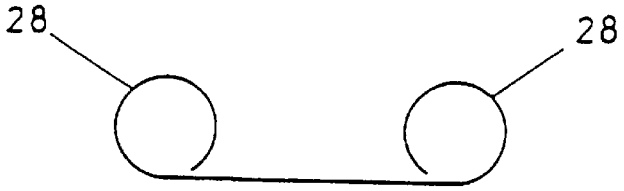
FIG. 5 is a cross-section through the line 5—5 of FIG. 1 showing the form that the paper takes up at that stage.
Figure 6:
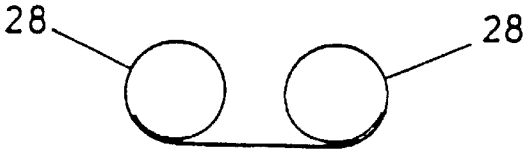
FIG. 6 is a cross-section through the line 6—6 of FIG. 1 showing the form that the paper takes up at that stage.

As the central part or the paper is under tension as it approaches the rubber rollers, and as the base of the former is flat, the edges 28 of the paper roll over in a controlled manner and around as shown progressively in FIGS. 4 to 6. When the paper is pushed into the gear wheels the rolls of paper from each side contact each other before being crushed in the central region 30 where multi layers, for instance eight, are connected leaving roughly oval shapes 32 at each side. It will be appreciated that the shape of the cross-section of the paper, particularly at the later stages, is shown schematically.

The blades 33A and 33B are each arranged to cooperate with an anvil plate 34. Each blade is connected to an associated cog 35A and 35B and is able to partially rotate when a chain 36 is pulled to cause one of the blades 35A to pass against the anvil plate 34 cut over half of the width of the dunnage and subsequently one of the blades 35B to cut the remainder of the dunnage.

As each blade does not pass through the whole of the width of dunnage the momentum of the blades is able to carry the blades through their reduced cutting stroke with less force or torque than would be required with a single blade that had to pass through the complete width.

The blades are encouraged to maintain a cutting action against the anvil by applying a small bending force at both ends of the anvil via jacking screws 37, as shown in FIG. 1. Furthermore as two blades extend from diametrically opposite parts of each cog the dunnage is able to be cut through upon a 180° rotation of the cogs, and the cutting life of the apparatus is more than doubled compared to the life with a single blade.

The modified embodiment shown in FIGS. 9 to 11 will now be described. The machine shown in those figures corresponds largely with those shown in the previous FIGS. 1 to 8, including the cross sectional views 4, 5 and 6 and only the differences will be described.

Figure 9:
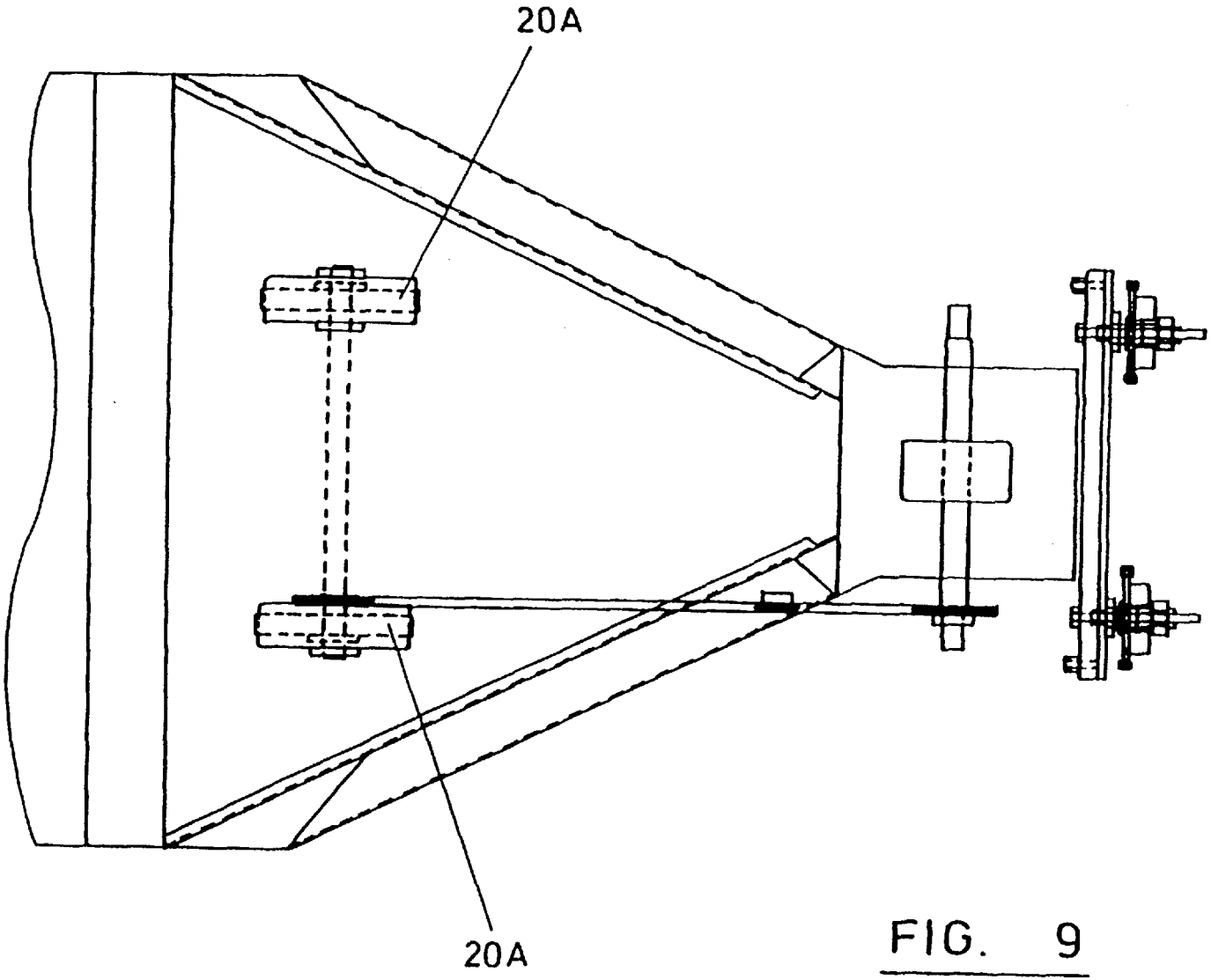
FIG. 9 is a plan view similar to FIG. 1 of an alternative dunnage forming machine.
Figure 10:
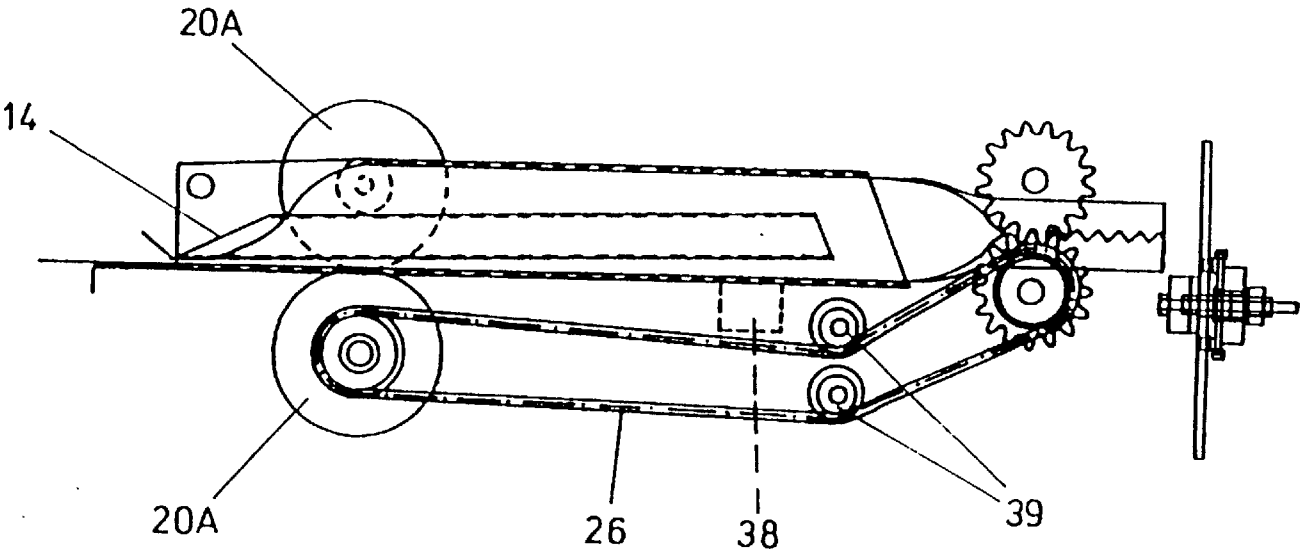
FIG. 10 is a side view of FIG. 9.

In FIG. 9 the downstream rollers 20B have been omitted and only the upstream rollers 20A are present. The lower rollers 20A are gear wheels to increase the traction exerted upon the paper as it is being fed and the drive belt 26 passes around idler wheels 39, to power the lower rollers from the motor 38. Furthermore, the upper flat tapering wall 14 is inclined upwardly in the downstream direction, as shown in FIG. 10.

Figure 11:
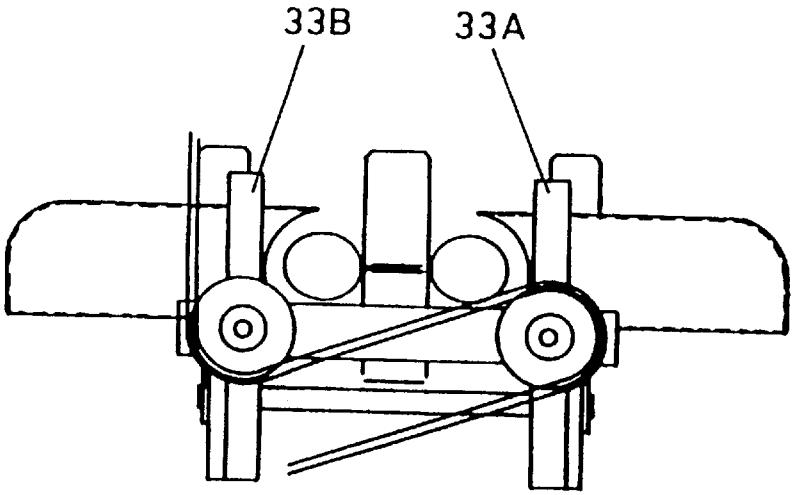
FIG. 11 is an end view of FIG. 9.

In FIG. 11, the blades 33A and 33B are shortened slightly and they are in place so that they simultaneously make a cut and just fail to meet at their remote ends when making the cut.

We claim:

1. In a packaging material making machine having a sheet material supply roller arranged to supply sheet material to a former, pulling means including at least one driven rotatable member arranged to pull the sheet material in a direction of travel from the supply roller to the former, and connecting means including at least one driven rotatable member located downstream of the pulling means and arranged to assist in maintaining overlapping layers of the sheet material together, characterized in that the pulling means are arranged to act along the former and in that the driving surface of the driven rotatable member of the pulling means is arranged to travel at a greater rate than the driving surface of the driven rotatable member of the connecting means in order to cause the sheet material to be pushed to the connecting means and thus to bunch, wherein the resulting packaging material is increased in bulk.

2. A machine as claimed in claim 1, in which the connecting means is a crimping means.

3. A machine as claimed in claim 1, in which the driven rotatable member of the pulling means is movable relative to the driven rotatable member of the connecting means.

4. A machine as claimed in claim 1, in which the driven rotatable member of connecting means is movable relative to the driven rotatable member of the pulling means.

5. A machine as claimed in claim 1, including a common drive for both the pulling means and the connecting means.

6. A machine as claimed in claim 1, in which the rotatable member of the pulling means has a diameter and the rotatable member of the connecting means has a diameter, and the diameter of the driven rotatable member of the pulling means is greater than the diameter of the driven rotatable member of the connecting means.

7. A machine as claimed in claim 1, in which the pulling means are a pair of rotatable members at least one of which includes a resilient surface.

8. A machine as claimed in claim 1, in which the former has an opening and the pulling means are arranged to act through the opening in the former.

9. A machine as claimed in claim 1, in which the connecting means are a pair of gears arranged to mesh with the sheet material passing between the gears.

10. A machine as claimed in claim 1, in which the former includes a generally flat surface against which the sheet material is arranged to travel.

11. A machine as claimed in claim 10, in which the flat surface has a lesser extent at a downstream location than at an upstream location in a direction transverse to the direction of travel of the sheet material.

12. A method of making packaging material comprising: employing pulling means to pull sheet material in a direction of travel from a supply roller and to push the sheet material from the supply roller to a part of the machine that at least partially connects overlapping portions of the sheet material and employing a former to cause the shape of the sheet material to change; and wherein (a) the pulling means acts along the former and (b) the pulling means travels at a greater rate than the part that at least partially connects overlapping portions of the sheet material and pulls the sheet material at a greater rate than the rate at which the sheet material passes through the part that at least partially connects overlapping portions of the sheet material, which causes the pulling means to push the sheet material to the part that at least partially connects the overlapping portions, causing the sheet material to bunch and the resulting packaging material to increase in bulk.

13. A method as claimed in claim 12, wherein the former has a generally flat surface.

* * * * *